United States Patent [19]

Kirjavainen

[11] 3,976,539

[45] Aug. 24, 1976

[54] ADJUSTABLE SLICE FOR THE HEADBOX OR THE LIKE OF A PAPER OR EQUIVALENT MACHINE

[75] Inventor: Alvi Kirjavainen, Jyvaskyla, Finland

[73] Assignee: Valmet Oy, Helsinki, Finland

[22] Filed: Aug. 18, 1975

[21] Appl. No.: 605,444

[30] Foreign Application Priority Data

Aug. 20, 1974 Finland ..... 2459/74

[52] U.S. Cl. ..... 162/344; 162/347

[51] Int. Cl.[2] ..... D21F 1/02

[58] Field of Search ..... 162/344, 347, 212

[56] References Cited

UNITED STATES PATENTS

| | | | |
|---|---|---|---|
| 3,014,527 | 12/1961 | Beachler | 162/347 X |
| 3,233,575 | 2/1966 | Williams, Jr. | 162/344 X |

FOREIGN PATENTS OR APPLICATIONS

| | | |
|---|---|---|
| 41,342 | 6/1969 | Finland |

*Primary Examiner*—S. Leon Bashore
*Assistant Examiner*—Richard V. Fisher
*Attorney, Agent, or Firm*—Steinberg and Blake

[57] ABSTRACT

At the slice region of a headbox or the like of a paper or equivalent machine, there is a front support structure which has an elongated substantially horizontal lower region situated adjacent an upper lip of the slice. An elongated strip extends along this lower region of the front support structure and projects downwardly beyond the latter where the strip terminates in an elongated substantially horizontal free edge defining the upper lip of the slice. An elongated plate is situated in front of and adjacent the front support structure, extending horizontally across the latter throughout the entire width of the slice, and this plate carries structure for adjusting the strip. A pair of supporting blocks, wedges, or the like are carried by the front support structure and are respectively situated substantially at Besselian points of the plate while carrying the latter and transmitting substantially all reaction forces which are substantially parallel to the front support structure between the latter and the plate.

8 Claims, 3 Drawing Figures

ADJUSTABLE SLICE FOR THE HEADBOX OR THE LIKE OF A PAPER OR EQUIVALENT MACHINE

BACKGROUND OF THE INVENTION

The present invention relates to structure at the slice region of a headbox or the like of a paper or equivalent machine. In particular, the present invention relates to the structure for supporting and adjusting a strip which defines the upper lip of the slice.

With respect to the state of the art, reference may be made to applicant's Finnish Pat. No. 41342.

As is well known, a conventional headbox has a front wall beam situated at the upper lip region of the headbox slice and carrying the structure at the upper lip region of the slice. As a result any deformations or deflection of this front wall beam will undesirably influence the geometry of the slice inasmuch as such deformations or deflections are necessarily transmitted to the upper lip structure, and as a result there is also an undesirable influence on the transverse profile of the stream of paper stock which flows through the slice.

Of course, the above factors are well known. In the prior art, in order to reduce the extent of deformation or deflection of the front wall beam it is designed as an extremely robust member and is supported at points close to its Besselian points according to which, as is well known, any deflection due to the weight of the beam itself and due to its uniformly distributed load is minimized. Such deflections and deformations of the front wall beam are brought about not only by the weight of the beam itself but also as a result of the pressure load derived from the stock suspension which flows in the headbox and as a result of the temperature differential which exists between the exterior and interior of the front wall beam. It is recognized that this temperature differential is at a maximum during the starting-up operations of the paper machine.

According to known practice in the art, fine adjustment of the size and geometry of the slice is brought about by way of adjustment of an edge strip which defines the upper lip of the slice and which is normally fixed to the front wall of the headbox beam which is adjacent the slice in such a way as to be adjustable, suitable screws being provided for this purpose. The fine adjustment of such a strip which can be carried out according to known arrangements has a disadvantage in that the deflection of the beam which carries the strip which defines the upper lip, this deflection being at its most undesirable magnitude during the unstable starting operations, is for the most part transmitted to the structure which carries the fine adjusting mechanism, so that such undesirable deflection is necessarily transferred also to the strip which forms the upper lip of the slice.

SUMMARY OF THE INVENTION

It is accordingly a primary object of the present invention to provide a structure which will avoid the above drawbacks.

In particular, it is an object of the present invention to provide for the fine-adjusting mechanism connected to the upper lip a supporting structure which will permit the front wall of the beam to have reduced dimensions as compared to the previously required dimensions for this structure, with this advantage being brought about by providing a construction according to which it is possible for the front wall to undergo a considerable deflection in its own plane without influencing the structure which carries the mechanism for bringing about the fine adjustment of the strip which forms the upper lip.

It is furthermore an object of the present invention to provide an arrangement according to which it becomes possible to utilize for the front wall beam, and in particular for a front wall thereof, materials less expensive than has heretofore been required. For example it is an object to be able to utilize to a greater extent than has heretofore been possible ordinary steel rather than stainless steel.

It is moreover an object of the invention to be able in certain applications to provide a construction according to which it becomes possible to completely eliminate the coarse adjusting structure for the upper lip, namely the structure for raising or lowering the entire beam which carries the upper lip, inasmuch as the range of fine adjustment can be made according to the invention sufficiently great in view of the production requirements of the paper machine to provide in itself the required range of adjustment, for example a fine adjustment range of 10 – 25 mm.

Thus, it is an object of the present invention to provide for structure which brings about a fine adjustment of a strip which forms the upper lip of the slice a support which is insulated from a front beam of the headbox to such a great extent that deformation and deflection of the front beam will have very little influence on the structure which carries the fine-adjusting mechanism for the strip which forms the upper lip of the slice.

According to the invention the fine-adjusting structure for the upper lip member is carried by a plate which has a length substantially equal to the width of the headbox and which is fixed to the front wall of the beam at the region of the upper lip by way of supporting wedges or blocks or the like at a pair of points situated longitudinally of the supporting plate at the region of the Besselian points thereof so that such supporting wedges or the equivalent thereof will transmit substantially all of the reaction forces, which are substantially parallel to the front wall of the front beam and which act between the front wall and the supporting plate, with this supporting plate carrying adjusting spindles or the like which form the fine-adjusting mechanism for the strip which forms the upper lip of the slice.

Thus, according to the invention there is provided at the slice region of a headbox or the like of a paper or equivalent machine, a front support structure which has an elongated substantially horizontal lower region situated adjacent an upper lip of the slice. An elongated strip extends along the lower region of this front support structure and projects downwardly beyond this lower region where the strip terminates in an elongated substantially horizontal free edge which defines the upper lip of the slice. An elongated plate is situated in front of and adjacent to the front support structure and extends horizontally across the latter throughout the entire width of the slice. This plate carries an adjusting means which is operatively connected with the strip so as to be capable of adjusting the latter. A pair of support means are carried by the front support structure while being respectively situated substantially at Besselian points of the plate, this pair of support means supporting the plate while transmitting all reaction forces substantially parallel to the front support structure between the front support structure and the plate.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
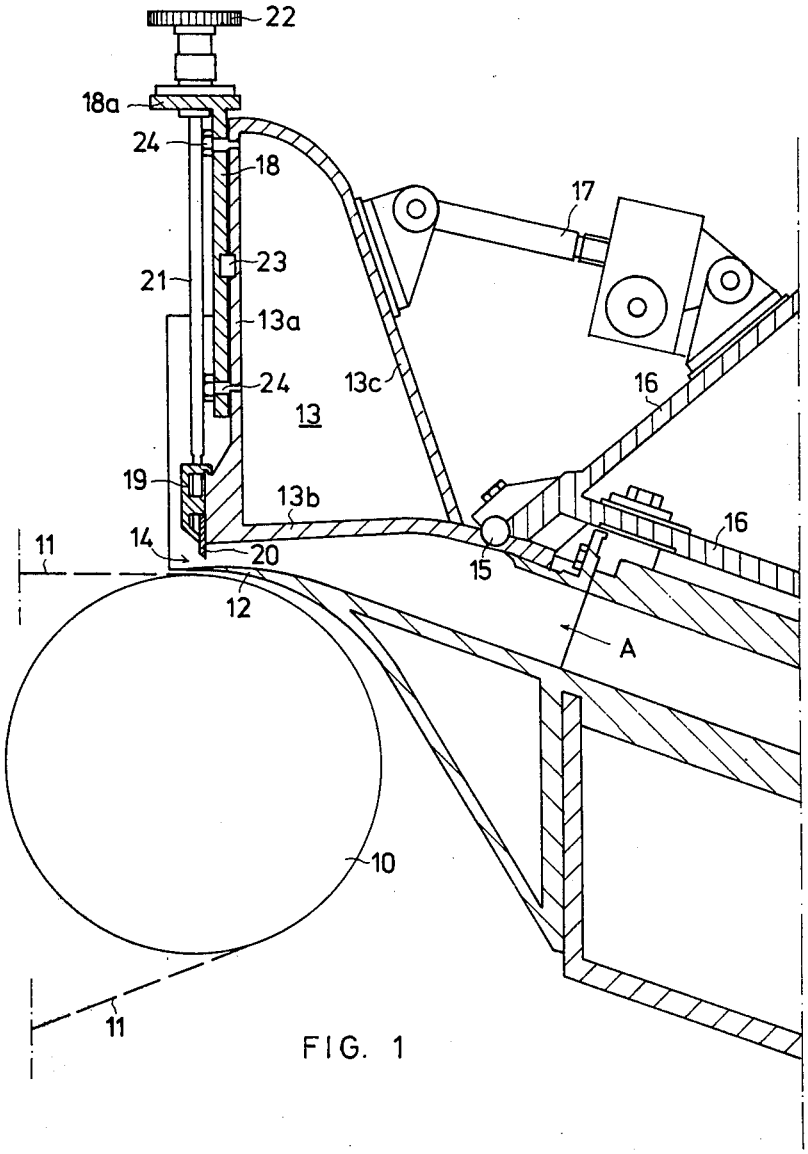
FIG. 1 is a sectional elevation of a hydraulic headbox provided with a fine adjusting mechanism according to the invention, the section of FIG. 1 being taken along line I—I of FIG. 2 in the direction of the arrows.
Figure 2:
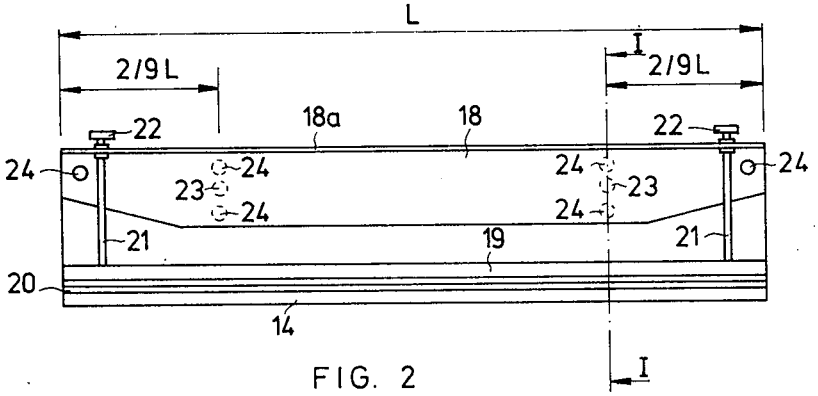
FIG. 2 is a schematic front elevation of the headbox structure as seen when looking toward the slice from the left of FIG. 1.

Referring first to FIGS. 1 and 2, the slice region of a hydraulic headbox is illustrated. FIG. 1 schematically illustrates part of the forming wire 11 whih travels around the breast roll 10 of the paper or equivalent machine. The slice is defined between a fixed lower lip beam 12 and an adjustable upper lip beam 13 which forms the front wall beam. The paper stock flows in the direction indicated by the arrow A through the passage illustrated in FIG. 1 to discharge out through the slice 14 onto the wire 11, as is well known.

The front support structure 13 has a lower front region where the elongated strip 20 is located, this strip 20 extending downwardly beyond the lower region of the front support structure 13 where the strip 20 terminates in a free lower edge which defines the upper edge of the slice 14. The support structure 13 is in the form of a box beam which is hollow and of substantially triangular cross section, this beam 13 having a front wall **13*a* as well as a lower wall 13*b* which confines the lip slice, and a rear wall 13*c*. Between this rear wall 13*c* of the beam 13 and the frame structure 16 of the headbox, there is a power means 17 which can be operated so as to swivel the upper lip beam 13 about a horizontal axis determined by the pivot structure 15, and it is this turning of the beam 13 about the horizontal axis determined by the pivot structure 15 which brings about a coarse adjustment of the size of the lip aperture or slice 14**.

Thus, along the lower margin or lower region of the front wall **13*a* of the upper lip beam 13 there is situated the edge strip 20 which can be displaced in a substantially vertical plane to bring about the fine adjustment of the size and geometry of the slice 14. The strip 20 is joined with an elongated horizontal holder 19 and can be displaced by way of the fine adjusting mechanism with respect to and along the front wall 13*a* of the front support structure or upper beam 13 so as to adjust in this way the size and geometry of the slice 14**.

In accordance with the present invention the supporting structure which carries the fine-adjusting mechanism for the strip 20 includes a plate 18 fixed to and carried by the front wall **13*a* of the beam 13 in a special manner. The plate 18 carries at its upper region a forwardly extending flange 18*a* which serves to support for rotary movement a plurality of adjusting spindles 21 which form the fine-adjusting mechanism. A series of these spindles 21 are distributed across the plate 18 and are rotatably supported in any suitable way at the flange 18*a*. Each spindle 21 has a hand wheel 22 by means of which the spindle 21 can be turned. In a manner which is known the strip 20 has a groove which receives the lower ends of the rotary adjusting spindles 21, these spindles being connected to the strip 20 in such a way that the position of the strip 20 in a vertical plane is adjusted by the rotary movement of the spindles 21**.

The plate 18 which carries the adjusting means 21 for the strip 20 is supported by the front wall **13*a* of the upper lip beam 13 at only two locations or points by way of a pair of supporting means formed by supporting wedges or blocks 23. These two supporting wedges or blocks 23 are situated, considered in the longitudinal horizontal direction of the supporting plate 18, close to the Besselian points, so that the deflection of the plate 18 is minimized. As is well known when a beam is supported on a pair of supports situated at the Besselian points, in the case where a load is distributed uniformly over the entire length of such a beam, the load consisting, for example, of the weight of the beam itself, then the deflection of such a beam is minimized where these points are the Besselian points. As is well known such Besselian points are situated at a distance of 2/9 of the length L of the beam inwardly from the ends thereof. Thus where the support plate 18 is considered as such a beam having a length L, as indicated in FIG. 2, then the pair of support means 23** are situated at the locations indicated in FIG. 2 inwardly from the ends of the beam by the illustrated distances each of which is equal to 2/9 L.

The pair of support means 23 serve to transmit all of the vertical reaction forces between the front wall **13*a* and the plate 18. In the particular example illustrated in the drawings, the pair of support means 23 take the form of simple circular cylindrical blocks fixedly carried by the wall 13*a* in suitable recesses thereof and projecting forwardly from the wall 13*a* into recesses at the rear surface of the plate 18 so as to carry the latter, and as will be apparent from the description which follows the pair of support means 23 forms the only structure which serves to carry and support the plate 18** together with the structure carried by the latter.

Figure 3:
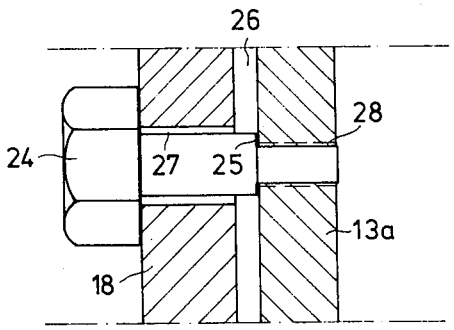
FIG. 3 is a fragmentary sectional elevation, at an enlarged scale as compared to FIGS. 1 and 2, showing a detail of part of the structure associated with the plate which carries the fine-adjusting mechanism for the upper lip member.

In order to securely mount the plate 18 so that it is supported only by the pair of support means 23 situated substantially at the Besselian points of the plate 18, the position of the plate 18 with respect to the wall **13*a* is securely determined by way of shoulder-bolts 24 which contribute to the securement of the plate 18 with respect to the wall 13*a* while at the same time transmitting no vertical reaction forces. The arrangement of the bolts 24 is apparent from FIG. 2. The details thereof are illustrated in FIG. 3 for one of the bolts. Thus as may be seen from FIG. 3, the plate 18 is situated forwardly of the wall 13*a* defining with the latter a free space 26. This space is of course bridged by the blocks or wedges 23. Also, the shanks of the bolts 24 extend through this space 26 between the rear surface of the plate 18 and the front surface of the wall 13*a*. At the location of each bolt 24 the plate 18 is formed with an opening through which the shank of the bolt 24 passes with clearance. This clearance is such as to leave all around the shank of the bolt 24 a space 27 as illustrated in FIG. 3, so that the shank of the bolt 24 does not engage the plate 18. It is only the head of each bolt 24 which engages the front surface of the plate 18 which is directed away from the wall 13*a*. Each bolt 24 has a threaded portion 28 threaded into the wall 13*a*** as illustrated in FIG. 3, and at the rear of its threaded portion 28 each bolt 24 has a shoulder 25 which engages the front surface of the wall 13*a*. Thus, the pair of support means 23 will form the only structure which carries the plate 18 so as to determine the elevation thereof, and the length of the blocks or the like which form the elements 23 is such that the front surface of the plate 18 engages the heads of the bolts 24 which extend freely through the plate 18 into connection with the wall 13*a* in the manner shown in FIG. 3 according to which there is no vertical support provided for the plate 18 by way of the bolts 24, this vertical support being provided only by the pair of support means 23.

As a result of the above-described structure of the present invention, the structure which carries the fine-adjusting mechanism for the strip 20, namely the plate 18, is subjected only to such forces as may arise from the fine adjustment itself, and these forces frequently cancel each other so that the supporting plate 18 will remain at all times virtually completely straight. The result is that the size and geometry of the slice can be maintained constant because the lip member 20 cannot be influenced by vertical deflections of the front wall 13*a* of the upper lip beam 13. In addition, because of the above-described structure of the invention it is possible to reduce the weight of the upper lip beam 13, as compared to corresponding components of the prior art, because it is possible to permit this upper lip beam 13 to carry out deflections in a vertical direction on the order of 2–3 mm without affecting in any way the adjustment of the strip 20.

What is claimed is:

1. For use at a slice region of a headbox or the like of a paper or equivalent machine, a front support structure having an elongated substantially horizontal lower region situated adjacent an upper lip of the slice, an elongated strip extending along said lower region of said front support structure and projecting downwardly beyond said lower region where said strip terminates in an elongated substantially horizontal free edge defining the upper lip of the slice, an elongated plate situated in front of and adjacent said front support structure and extending horizontally across the latter throughout the entire width of the slice, said plate carrying an adjusting means which is operatively connected with said strip for adjusting the latter, and a pair of suport means carried by said front support structure, respectively situated substantially at Besselian points of said plate, and supporting the latter whle transmitting substantially all reaction forces substantially parallel to said front support structure between said front support structure and said plate.

2. The combination of claim 1 and wherein said front support structure includes a front wall having said lower region of said support structure and extending upwardly from said lower region while being parallel to said plate and carrying said pair of support means.

3. The combination of claim 2 and wherein said support structure includes a hollow beam the front of which is formed by said wall.

4. The combination of claim 1 and wherein said pair of support means respectively include a pair of blocks carried by said front support structure and projecting forwardly therefrom, said plate having a rear surface directed toward said front support structure and formed substantially at said Besselian points of said plate with recesses respectively receiving said blocks and the latter blocks forming the only structure which carries said plate.

5. The combination of claim 4 and wherein said blocks situate said plate at a location spaced slightly from and forwardly of said front support structure.

6. The combination of claim 5 and wherein said plate is formed with a plurality of openings, and a plurality of bolts extending with clearance through said openings and having shanks which do not engage said plate, said bolts having heads which engage a front surface of said plate which is directed away from said support structure and having threaded portions threaded into said front support structure while having at rear ends of said threaded portions shoulders which engage a front surface of said support structure which is directed toward said plate.

7. The combination of claim 1 and wherein said plate has an elongated upper flange projecting forwardly from the remainder of said plate and carrying said adjusting means.

8. The combination of claim 7 and wherein said adjusting means includes a plurality of rotary spindles extending through said flange and operatively connected with said strip.

* * * * *